US011306438B2

(12) United States Patent
Zou et al.

(10) Patent No.: US 11,306,438 B2
(45) Date of Patent: Apr. 19, 2022

(54) PRESS COVER, USE THEREOF, AND PRESS ROLL AND SHOE PRESS

(71) Applicant: VOITH PATENT GMBH, Heidenheim (DE)

(72) Inventors: Juanhao Zou, Heidenheim (DE); Richard Westerholz, Heidenheim (DE); Simon Ermert, Neu-Ulm (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/265,005

(22) PCT Filed: Jun. 13, 2019

(86) PCT No.: PCT/EP2019/065493

§ 371 (c)(1),
(2) Date: Feb. 1, 2021

(87) PCT Pub. No.: WO2020/025210

PCT Pub. Date: Feb. 6, 2020

(65) Prior Publication Data

US 2021/0324579 A1 Oct. 21, 2021

(30) Foreign Application Priority Data

Aug. 1, 2018 (DE) ..... 102018118603.7

(51) Int. Cl.

| | |
|---|---|
| ***D21F 3/02*** | (2006.01) |
| ***D21F 3/08*** | (2006.01) |
| ***D21F 7/08*** | (2006.01) |

(52) U.S. Cl.
CPC ..... *D21F 3/0227* (2013.01); *D21F 3/08* (2013.01); *D21F 7/083* (2013.01)

(58) Field of Classification Search
CPC ..... D21F 3/0227; D21F 7/083; D21F 3/08; D21F 3/02
See application file for complete search history.

(56) References Cited

U.S. PATENT DOCUMENTS

| | | | | |
|---|---|---|---|---|
| 5,772,848 | A * | 6/1998 | Dutt | D21F 3/0227 162/358.4 |
| 6,465,074 | B1 * | 10/2002 | FitzPatrick | D03D 1/0094 428/131 |
| 2005/0003724 | A1 | 1/2005 | FitzPatrick | |
| 2011/0277258 | A1 * | 11/2011 | Otsuka | A47L 13/256 15/209.1 |

FOREIGN PATENT DOCUMENTS

| | | | |
|---|---|---|---|
| DE | 202017006805 | U1 | 7/2018 |
| EP | 1087056 | A2 | 3/2001 |
| WO | 2015091654 | A1 | 6/2015 |

* cited by examiner

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A press cover has at least one polymer layer in which a reinforcing structure is embedded. The reinforcing structure has at least one reinforcing thread as a longitudinal thread which runs in the longitudinal direction of the press cover. The at least one reinforcing thread itself is produced by interlacing a plurality of fibers or fiber bundles with one another. There is also described the use of such a press cover, as well as a press roll and a shoe press.

15 Claims, 2 Drawing Sheets

PRESS COVER, USE THEREOF, AND PRESS ROLL AND SHOE PRESS

BACKGROUND OF THE INVENTION

Field of the Invention

The invention is based on a press cover, in particular for a pressing device for treating a fibrous material web, for example to smooth or dewater the same, in detail as claimed in the independent claims. The invention also relates to a press roll, a shoe press and the use of a press cover in such a shoe press, in detail as claimed in the subordinate claims.

Pressing devices such as shoe presses have for a long time been a constituent part of modern paper machines. They substantially comprise a shoe arranged in a stationary manner (also called a press shoe), which extends in a cross-machine direction, and a press cover running around the stationary shoe. Said press cover is deformable and, in operation, substantially assumes a tubular shape. The shoe is shaped such that it forms a press nip (press gap) with an opposing roll. The press nip is defined by the contact surface of the opposing roll in the shoe. The shoe is designed to be movable and can be moved onto the opposing roll.

Enormous requirements in relation to its stability are placed on the press cover, specifically with regard to surface hardness, resistance to pressure, temperature and hydrolysis. The press cover is additionally exposed to high alternating bending loadings during operation. As it runs in at the shoe edge—before the press nip as seen in the direction of rotation of the press cover—bending over a comparatively small radius takes place first. This changes immediately into an opposite bending as it passes through the press nip. As it runs out at the other shoe edge, therefore—after the press nip as seen in the direction of rotation of the press cover—opposite bending takes place again. This deformation of the press cover as it runs in and out is also designated as an alternating nip. It can easily be seen that the tendency of the press cover to fracture, especially at this point, is very high as a result of the high mechanical stress. Accordingly, many measures which are intended to increase the stability of the press cover are known from the prior art.

The press cover must therefore be sufficiently flexible in order that it can be led around the shoe; it must be sufficiently rigid in order that it is not too highly deformed or compressed under the press load in the nip, and it must be sufficiently wear-resistant. Press covers therefore consist of a single-ply or multi-ply polymer layer, preferably of polyurethane, into which reinforcing threads in the form of laid or woven fabrics can be embedded.

The present invention relates to such objects of the generic type mentioned at the beginning.

Press covers known from the prior art tend to fail prematurely during intended operation as a result of—often only local—overloading in the nip. Such overloading arises when a foreign body goes through the nip during what is known as a lump passage. Such overloading often leads to the reinforcing threads or the polymer layer into which they are embedded tearing. A press cover which is oil-lubricated from the inside can become leaky, so that the oil comes into contact with the fibrous material web to be produced. The press cover must be changed as a result. In practice, this leads to unplanned stoppages in the press device and therefore to increased, costly downtimes.

SUMMARY OF THE INVENTION

It is accordingly an object of the invention to specify a press cover which avoids the disadvantages of the prior art.

In particular, the intention is for even only local damage to the press cover as a result of overloading during intended operation to be prevented. The press cover should therefore withstand such short-term overloads and therefore its service life should be prolonged and the stoppage times for a press device equipped with such a press cover should be reduced.

The object is achieved by the features of the independent claims. Particularly preferred and advantageous embodiments of the invention are reproduced in the sub-claims.

The inventors have discovered that the press cover is able to compensate better for local overloads than the press covers known from the prior art if the reinforcing threads are formed in a particular way. According to the invention, reinforcing threads are used at least as longitudinal threads, which are produced by interlacing individual fibers or fiber bundles with one another. This means that use is made of reinforcing threads, the fibers or fiber bundles of which were not twisted. Reinforcing threads known from the prior art are all twines or yarns. This means that these are produced by twisting (rotating together) a plurality of fiber bundles. Investigations have shown that the use of reinforcing threads according to the invention, embedded into a polymer layer, also leads to low separation of the material of the polymer from the reinforcing threads. In other words, the reinforcing threads according to the invention have a lower tendency to being detached from the polymer layer embedding the same during a lump passage to a lesser extent. In this way, the service life of such a press cover is increased. At the same time, the frequency of the stoppage of a press device equipped with the press cover is reduced.

The definition that at least the longitudinal threads are produced as reinforcing threads according to the invention means that only the longitudinal threads are designed in this way or, in addition, the longitudinal threads and at least one further circumferential thread are produced in this way. If, preferably, for example a laid fabric made of circumferential and longitudinal threads is present, then this means that at least the longitudinal threads are made according to the invention. In other words, the at least one circumferential thread can then be conventionally twisted, that is to say the fiber bundles of a reinforcing thread designed as a circumferential thread can be twisted with one another, that is to say can be free from being interlaced with one another. In principle, however, it would be conceivable also to produce the circumferential threads like the longitudinal threads, specifically such that the fibers or fiber bundles thereof are interlaced with one another.

In the sense of the invention, a press cover is to be understood as a belt, flexible tube or a cover which, as illustrated, is led through the press nip of a shoe press together with a fibrous material web. To dewater the fibrous material web, during intended operation the radially outermost surface (polymer layer) of the press cover can come into contact with a press felt, by which the fibrous material web to be dewatered is carried directly. Depending on the embodiment of the press apparatus, for example to smooth said fibrous material web, the press cover can also come directly into contact with the fibrous material web in intended operation. The press cover is embodied in this case as a closed cover (flexible tube) that is endless in the circumferential direction around its longitudinal axis. At its axial ends, it is open—as seen in the width direction (along the longitudinal axis). Therefore, at these axial ends, the press cover can be held by two lateral clamping disks in order to form the shoe press roll. Instead of being guided by the two lateral clamping disks, the press cover can be led over the press shoe and a plurality of guide rolls, as is the case in open shoe presses. Irrespective of whether the press cover is guided by the clamping disks or the guide rolls, the press shoe (or the guide rolls) comes into contact (temporarily) with part of the radially innermost surface of the press cover. The radially outermost surface of such a press cover, that is to say, for example, the radially outermost polymer layer of the same, can be provided with grooves and/or blind holes.

Longitudinal direction means that direction which extends parallel to the longitudinal axis of the press cover. At the same time, the longitudinal axis corresponds to the axis of symmetry or rotation of the finished press cover and the press roll. The circumferential direction of the press cover, as seen about its radial boundary, extends around the longitudinal axis. The term parallel also includes those angular deviations of two reinforcing threads lying in different planes of +/−5° relative to each other.

The press cover or the at least one polymer layer can be produced partly or completely from a polymer. The polymer used can be a castable, curable, preferably elastomeric polymer such as polyurethane. Consequently, the polymer can be configured as a casting elastomer.

Polymer layer means a layer which comprises such a castable, curable, preferably elastomeric polymer or is produced completely therefrom. Preferably, the polymer layer can be a single-component cured layer produced by primary molding. In other words, this is monolithically primary-molded, that is to say produced, for example, by casting. The term single-component also includes cases in which the one layer has in turn been produced from multiple plies of the same material during the casting of the polymer. However, this is only to the extent that these plies are substantially no longer visible following the curing, instead that a single, preferably uniform layer results. The same applies correspondingly to the finished press cover.

When a plurality of polymer layers is provided, these can be arranged one above another as seen in the radial direction—at least partially over the width of the press cover. At least partially over the width of the press cover means that the press cover has only one layer, for example at its axial ends along the longitudinal axis of the press cover, whereas it is formed of two or more layers between the axial ends. The polymer layers can, however, also extend over the entire width of the press cover. The thickness of the press cover—and thus the thickness of the individual polymer layers—can also vary to some extent along the longitudinal axis in a section through its longitudinal axis. Thus, for example, the radially outermost polymer layer in the region of the width edges of the press cover can be smaller than in the center of the press cover. In other words, in the region of the width edges, the radially outermost polymer layer can be less thick than a radially inner or radially innermost polymer layer. Preferably, exactly one, two or three polymer layers is/are provided. These can be designed identically with regard to their polymer or vary with regard to their hardness or stoichiometry of the prepolymer. An overall thickness of the finished press cover in a section through the longitudinal axis of the same, measured in the radial direction, can be 5 to 10 mm, preferably 5 to 7, particularly preferably 5 to 6 mm. According to the invention, when a single layer is provided, the press cover can be produced from only one casting, i.e. monolithically, so that the single layer has the thickness just mentioned.

A finished press cover in the sense of the invention is one of which at least one polymer layer is cured and possibly finally machined, that is to say is ready for use for the purpose mentioned at the beginning in, for example, a shoe press. Analogously, a finished polymer layer means a layer which is cured.

In the sense of the invention, a reinforcing thread is understood to be a flexible, textile linear structure which has a dominant extent and a uniformity in its in longitudinal direction. The reinforcing thread is produced from a plurality, that is to say at least two, fibers or at least two fiber bundles by interlacing the same with one another. If mention is made of fiber, then a single, endless fiber of a monofilament type is meant. If, on the other hand, mention is made of a fiber bundle in the sense of the invention, this does not mean monofilaments but, for its part, an individual thread such as a twine or yarn, that is to say a bundle of endless fibers or monofilaments. The fiber bundles themselves can indeed be produced from fibers twisted with one another. However, it is a matter of whether the reinforcing thread is ultimately achieved by interlacing a plurality of fiber bundles.

The term reinforcing structure in the sense of the invention means a reinforcement of the at least one layer containing the polymer or consisting of the latter—that is to say the polymer layer. The reinforcing structure can be embedded herein completely into the polymer layer, so that the reinforcing structure does not go beyond the boundary of the polymer layer. In other words, the polymer layer performs the role of a matrix which surrounds the reinforcing structure and binds the same to the matrix as a result of adhesion or cohesion forces. Such a reinforcing structure can comprise textile linear structures—e.g. yarns or twines—and/or textile surface structures—such as, for example, woven, knitted, crocheted, braided or laid fabrics—and can be producible from an appropriate starting material, for example by winding. In other words, an individual reinforcing thread according to the invention, considered on its own, is a textile linear structure. A plurality of such reinforcing threads can be designed, for example, as a longitudinal and/or circumferential thread such that, together, they form a textile surface structure. The at least one reinforcing thread which is embedded into the at least one polymer layer then represents the reinforcing structure of the press cover or the polymer layer of the same. Starting material is understood to mean that material or semifinished product by means of which the reinforcing structure of the finished press cover according to the invention is produced.

Twisting is understood to mean that operation in which individual fiber bundles are twisted together with one another. Twisting corresponds to so-called laying during the production of cords.

The term braiding or interlacing means the regular twisting of a plurality of fibers or fiber bundles into one another. The difference from weaving lies in the fact that during braiding, the fibers or fiber bundles are not fed in at right angles to the main product direction.

In principle, it is conceivable that the individual fibers or fiber bundles of a respective reinforcing thread can be braided with one another about a core, as is the case, for example, in dynamic ropes such as climbing ropes. The core can be produced from a different material than that of the fibers or the fiber bundle. It can have, for example, a higher extensibility in order to store the energy temporarily in the core during overloads in a way analogous to the climbing ropes, so that the entire reinforcing thread becomes longer or else thinner for this purpose during local overloading.

The reinforcing thread or the reinforcing structure can be produced from a polymer or comprise one such. Suitable polymers are polyester, polyethylene naphthalate or polyamides, such as aramids.

In the sense of the invention, a press device means, for example, a shoe press, for example for dewatering or treating, such as smoothing, a fibrous material web. The shoe press comprises a shoe press roll and an opposing roll, which, together, form or delimit a press nip. The shoe press roll further comprises a rotating press cover and a stationary press element, the so-called press shoe. The latter is supported on a load-bearing, likewise stationary yoke—for example via hydraulic press elements—and is pressed onto the rotating press cover. The press cover rotates relative to the stationary press shoe and yoke and, as a result, is pressed onto the opposing roll in the press nip. The press shoe and yoke are arranged radially within the press cover. The term stationary is understood to mean that the press element does not rotate relative to the shoe press roll or the opposing roll but can move translationally—toward the opposing roll and away from the latter, preferably in the radial direction thereof—and therefore relative to the opposing roll. In addition to the fibrous material web and the press cover, one or more press felts circulating endlessly in the circumferential direction and/or further endlessly circulating press belts can be guided through the press nip of the shoe press. Such a shoe press can, of course, comprise more than one press nip.

In the sense of the invention, a fibrous material web is to be understood as a laid fabric or tangled fabric of fibers, such as wood fibers, plastic fibers, glass fibers, carbon fibers, additional materials, additives or the like. Thus, the fibrous material web can be formed, for example, as a paper, board or tissue web. It can substantially comprise wood fibers, wherein small quantities of other fibers or else additional materials and additives can be present. This is left up to those skilled in the art, depending on the use.

The advantages of the invention are particularly satisfactorily fulfilled if an odd number of fibers or fiber bundles are braided with one another to produce the corresponding (single) reinforcing thread with one another. A flat braid in the manner of a stranded wire, such as a solder removal wire, that is to say a flat small tape is then produced. Flat means in the case that, in the cross section through its longitudinal extent, the greatest width direction (e.g. width diagonal) always represents a multiple of the greatest vertical extent (e.g. vertical diagonal). However, it would also be conceivable to braid an even number of such fiber bundles with one another to form a reinforcing thread, a round braid then being obtained.

In principle, investigations have shown that both flat and also round braids are associated with better properties than reinforcing threads produced only (completely) by twisting according to the prior art.

If, preferably, a plurality of reinforcing threads as longitudinal threads and at least one reinforcing thread as a circumferential thread, which surrounds the longitudinal threads in the circumferential direction, are embedded as a laid fabric into the polymer layer, then the advantages according to the invention are particularly well fulfilled. This is because a laid fabric is capable of absorbing local overloadings particularly well.

The advantages according to the invention are achieved particularly well if the press cover is built up from preferably a plurality of polymer layers arranged one above another in the radial direction. If two polymer layers are provided, then the radially inner one is that having the reinforcing structure according to the invention. This means that the reinforcing structure is arranged only in the radially innermost polymer layer. If three or more polymer layers are provided, then the reinforcing structure is preferably arranged in the second lowest polymer layer, that is to say in that polymer layer which lies radially above the radially innermost polymer layer.

The invention also relates to a press roll, such as a shoe press roll, for a shoe press for dewatering a fibrous material web, wherein the press roll has at least one press cover according to the invention.

The invention also relates to a shoe press for dewatering a fibrous material web, preferably a paper, board, tissue or pulp web, comprising a press roll and an opposing roll, which together form or delimit a nip, wherein the press roll comprises a rotating press cover, wherein the press cover is formed according to the invention.

Finally, the invention relates to the use of a press cover according to the invention for a press, such as a shoe press for dewatering a fibrous material web, preferably a paper, board, tissue or pulp web.

The invention will be explained in more detail below with reference to the drawings without restricting generality.

DETAILED DESCRIPTION OF THE INVENTION

Figure 1:
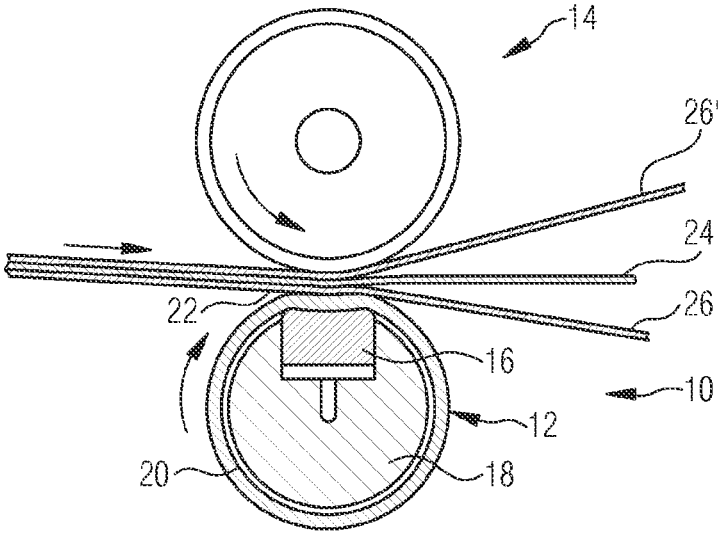
FIG. 1 shows a partly sectioned, schematic side view of a shoe press having a press cover according to an exemplary embodiment of the present invention.

FIG. 1 illustrates a partly sectioned, schematic side view of a shoe press 10 which, in the present case, comprises a press roll according to the invention, such as a shoe press roll 12, and an opposing roll 14. With regard to their longitudinal axes, the shoe press roll 12 and opposing roll 14 are arranged parallel to each other. Together, they form a nip 22 or delimit such a nip.

While the opposing roll 14 here consists of a cylindrically configured roll rotating about its longitudinal axis, the shoe press roll 12 is assembled from a shoe 16, a stationary yoke 18 carrying the latter and a press cover 20. In relation to the opposing roll 14 and the press cover 20, the shoe 16 and yoke 18 are arranged to be stationary. This means that they do not rotate. The shoe 16 is supported herein by the yoke 18 and, via hydraulic press elements, not illustrated, is pressed onto the radially innermost surface of the press cover 20 rotating relative thereto. The press cover 20, which surrounds the shoe 16 and the yoke 18 in the circumferential direction, in the process rotates about its longitudinal axis in the opposite direction of rotation to the opposing roll 14. Because of the concave configuration of the shoe 16 on its side facing the opposing roll 14, a comparatively long nip 22 results.

The shoe press 10 is suitable in particular for dewatering fibrous material webs 24. During the operation of the shoe press, a fibrous material web 24 is guided through the press gap 22 with one or two press felts 26, 26'. In the present case, there are exactly two press felts 26, 26', which accommodate the fibrous material web 24 between them in the manner of a sandwich. During the passage through the nip 22, a pressure is exerted indirectly on the fibrous material web 24 in the nip 22 through the press felts 26, 26'. This is done by the radially outermost surface of the opposing roll 14, on the one hand, and the radially outermost surface of the press cover 20 coming directly into contact with the corresponding press felts 26, 26'. The liquid emerging from the fibrous material web 24 is temporarily picked up by the press felt or felts 26, 26' and any depressions (not illustrated) provided in the press cover surface. After leaving the nip 22, the liquid picked up by the depressions of the press cover 20 is thrown off before the press cover 20 enters the press gap 22 again. In addition, the water picked up by the press felt 26, 26' can be removed by suction elements after leaving the press gap 22.

In a further embodiment of the invention, not illustrated in the figures, it is possible to omit the press felts 26, 26'. In such a case, the fibrous material web 24 is directly in contact with the press cover 20 on the one hand and on the other hand with the opposing roll 14 which, together, form a press nip. Said opposing roll 14 can then be designed as a heated drying cylinder.

The press cover illustrated in FIG. 1 can be designed according to the invention, as illustrated in the following figures.

Figure 2A:
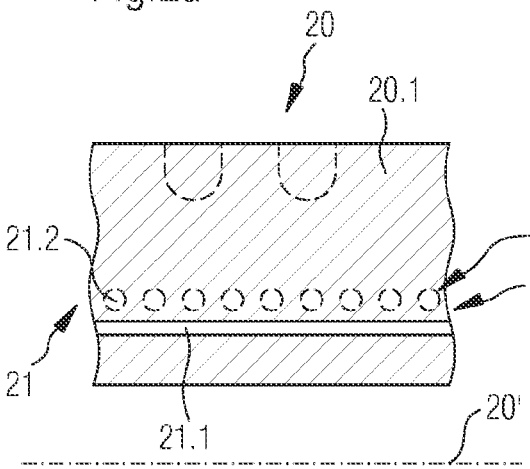
FIGS. 2*a* and 2*b* show embodiments of a press cover, as seen in each case in a section through its longitudinal axis.
Figure 2B:
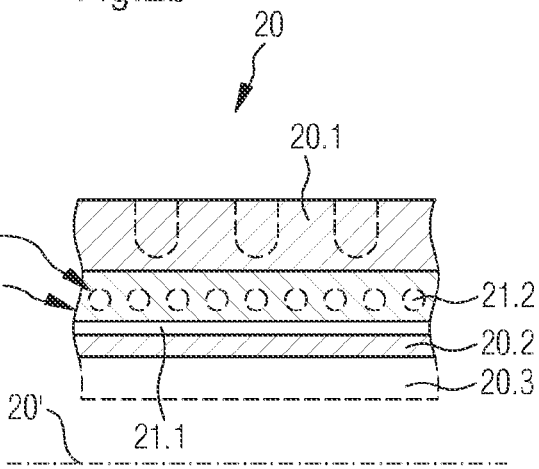

In FIGS. 2*a* and 2*b*, different embodiments of the invention are illustrated in a partially illustrated cross section, not to scale, through the longitudinal axis 20' of the finished press cover 20. The distance of the longitudinal axis 20' to the radially innermost surface of the corresponding polymer layer of the press cover 20 is likewise not illustrated to scale.

The illustration of FIG. 2*a* shows a press cover 20 having a single polymer layer 20.1. A reinforcing structure 20" is embedded therein. In the present case, the polymer layer 20.1 is produced from a polyurethane. This can be obtained from a prepolymer and a crosslinker.

According to the illustration of FIG. 2*b*, exactly two polymer layers are provided in unbroken lines, namely a first 20.1 and a second 20.2. In the present case, the first polymer layer 20.1 is simultaneously the radially outermost polymer layer of the press cover 20. The arrangement relates—as also in the illustration of FIG. 2*a*—as viewed starting from the longitudinal axis 20' of the press cover 20 in the radial direction thereof. On the other hand, the second polymer layer 20.2 is simultaneously the radially innermost polymer layer of the press cover 20. The two polymer layers 20.1, 20.2 adjoin each other directly as viewed in the radial direction, i.e. there is no intermediate layer between these two. A third polymer layer 20.3 is also indicated in dashed lines. The last-named is arranged radially within the second polymer layer 20.2. In the present case, a (single) reinforcing structure 20" is provided only in the second polymer layer 20.2. Of course, this could also be different, so that, alternatively or additionally, such a reinforcing structure 20" could also be arranged in the first polymer layer 20.1 and/or the third polymer layer 20.3. Here, too, the first and the second polymer layer 20.1, 20.2 are each produced from a polyurethane or contain one such. That stated also applies analogously to FIG. 2*a*.

The reinforcing structure 20" in the two embodiments of FIG. 2 is respectively embedded completely into the corresponding polymer layer 20.1 or 20.2. This means that the reinforcing structure 20" does not extend beyond the limits of the polymer layer 20.1, 20.2. In principle, it would be conceivable for the reinforcing structure 20" to extend beyond the limit of two, immediately adjacent polymer layers 20.1, 20.2, 20.3. In other words, the reinforcing structure 20" would be simultaneously embedded into two adjacent polymer layers 20.1, 20.2, 20.3.

The reinforcing structure 20" can herein consist of a plurality of reinforcing threads 21 formed as longitudinal threads 21.1. These extend parallel to the longitudinal axis 20' of the press cover 20 and are arranged relative to one another so as to be distributed at a distance over the circumference thereof. This can best be seen in FIG. 3.

In addition, one or more reinforcing threads 21 each extending spirally over the circumference of the corresponding polymer layer 20.1, 20.2 and designed as circumferential threads 21.2 can also be provided, once more see FIG. 2. The last-named are indicated by broken circles drawn in FIGS. 2*a* and 2*b*. In the illustration of FIG. 2, the plurality of longitudinal threads 21.1 and the at least one circumferential thread 21.2 form a laid fabric with one another. Here, the circumferential threads 21.2 are arranged in such a way that they surround the longitudinal threads 21.1, that is to say are arranged radially further out than the longitudinal threads 21.1. Longitudinal threads 21.1 and the at least one circumferential thread 21.2 cross one another as viewed in the radial direction as a result of the spiral winding of the at least one circumferential thread 21.2. As viewed in the radial direction (that is the say in the sectional illustration of FIGS. 2*a* and *b*), they do not touch at these crossing points, however, but are arranged at a distance from one another. This has the advantage that an improved force distribution from local overloads acting radially on the press cover 20 from the outside is transferred in the radially inward direction onto the longitudinal threads 21.1 via the at least one circumferential thread 21.2.

As indicated in FIG. 2, the radially outermost surface of the press cover 20 or the corresponding polymer layer 20.1 can have grooves or blind holes.

Figure 4A:
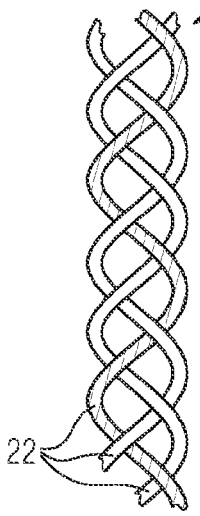
FIGS. 4*a* and 4*b* show a highly simplified illustration, not to scale, of an end of a reinforcing thread according to the invention.
Figure 4B:
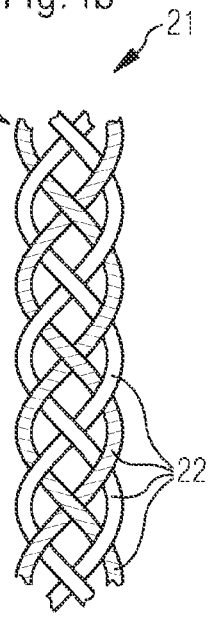

FIGS. 4*a* and 4*b* show a highly simplified illustration, not to scale, of an end of a reinforcing thread 21 according to the invention, which can be designed as a longitudinal thread 21.1 and/or a circumferential thread 21.2. The illustration shows for clarity how such a reinforcing thread 21 is produced, i.e. the distances of the individual fibers or fiber bundles 22 from one another are illustrated exaggeratedly large.

In the illustration of FIGS. 4*a* and *b*, both reinforcing threads 21 are produced by braiding a plurality of fibers or fiber bundles 22. In FIG. 4*a*, an odd number of fibers or fiber bundles 22 (here: three) is herein provided, so that a reinforcing thread 21 which is a flat braid results therefrom. In FIG. 4*b*, on the other hand, an even number of fibers or fiber bundles 22 (here: four) is provided, so that a round braid results as a reinforcing thread 21. In both cases, the fibers or fiber bundles 22 of each reinforcing thread 21 are intertwined in the manner of a plait.

The reinforcing thread 21 illustrated in FIGS. 4*a* and *b* can be used as a longitudinal or circumferential thread 21.1, 21.2 in the reinforcing structure 20" of the press cover 20, as explained in the preceding figures.

Figure 3:
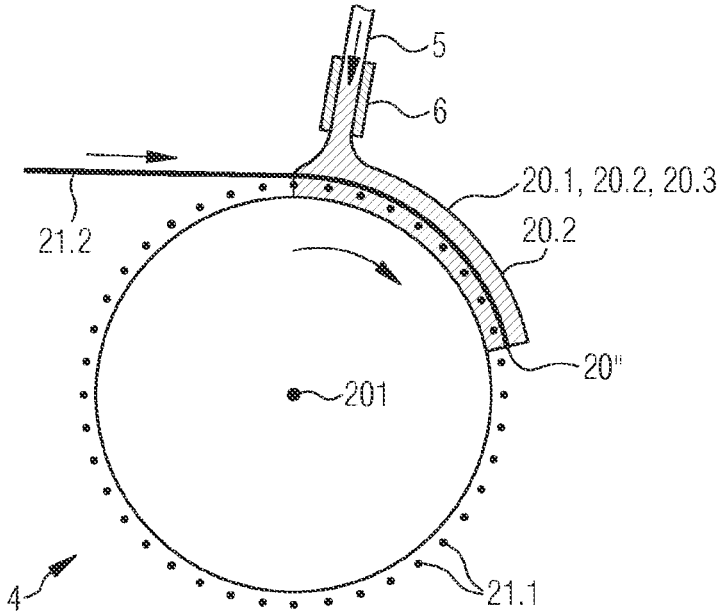
FIG. 3 shows a highly schematic illustration of a device for producing the press cover in a side view.

FIG. 3 shows a device for producing a press cover 20 according to the invention in a highly schematic side view. The device in the present case has exactly one cylindrical winding mandrel 4. On the circumference, a plurality of reinforcing fibers 21 formed as longitudinal threads 21.1 are provided at a distance from one another. A polymer is applied to the radially outermost circumferential surface of the winding mandrel 4 in order to apply a polymer layer

20.1, 20.2, 20.3—as described in the preceding figures. In addition, for example, a circumferential thread 21.2 is introduced spirally into the polymer of the polymer layer 20.1, 20.2, 20.3. The circumferential thread 21.2, after being embedded into the polymer together with the longitudinal threads 21.1, forms the reinforcing structure 20" of the finished press cover 20 according to the invention.

The winding mandrel 4 is rotatably mounted about its longitudinal axis 20', which corresponds to the longitudinal axis of the press cover to be produced. The longitudinal axis 20' here extends perpendicularly into the drawing plane. Via a line 5, the casting material, such as a castable, curable elastomeric polymer, for example polyurethane, is discharged from above through a casting nozzle 6 onto the radially outermost circumferential surface of the winding mandrel 4 and onto the longitudinal threads 21.1. Such a casting material can, for example, be chosen with regard to its pot-time and viscosity in such a way that it does not drip off the winding mandrel 4 during the casting. During this process, the winding mandrel 4 is rotated about its longitudinal axis in the direction of the arrow. At the same time as this rotation, the casting nozzle 6 is guided along in a relative manner on the winding mandrel 4, parallel to and along the longitudinal axis 20', via a suitable guide which is not further illustrated in FIG. 3. At the same time as the casting material is poured on, the at least one circumferential thread 21.2 is unwound and wound spirally onto the rotating winding mandrel 4 to form helices. The casting material can herein pass through the longitudinal threads 21.1 as far as the winding mandrel 4. In this example, following the curing step, the polymer forms a radially innermost and preferably elastomeric polymer layer which, for example, corresponds to the polymer layer 20.1 of the press cover from FIG. 2*a*, of which only a part is shown in FIG. 3.

The casting material emerging from the casting nozzle 6 is a mixture of a prepolymer and a crosslinker. The former is provided from a prepolymer container, not shown, in which it is stored or stirred. The prepolymer can comprise an isocyanate according to the invention and a polyol. It can be present in the prepolymer container, for example, in the form of a prepolymer made of the materials just mentioned. The crosslinker can be provided in a crosslinker container. The prepolymer container and the crosslinker container are assigned to the device for producing a press cover 20. They have a flow-carrying connection via lines, likewise not shown, to a mixing chamber (not illustrated) connected upstream of the casting nozzle 6 in the flow direction. The prepolymer-crosslinker mixture is thus produced upstream and outside of the casting nozzle 6, i.e. mixed in the mixing chamber. Irrespective of the production of the mixture, the latter is then applied to the surface of the winding mandrel 4 to form the at least one polymer layer of the press cover 20.

By means of such a continuous casting process, which is also known as rotational casting, an endless, cylindrically tubular press cover 20, which is intrinsically closed about its longitudinal axis 20' and the inner circumference of which corresponds substantially to the outer circumference of the winding mandrel 4, is therefore gradually produced over the width of the winding mandrel 4.

In principle, it would be conceivable to wind the reinforcing threads 21 onto more than the one winding mandrel 4 shown in FIG. 3. For example, two winding mandrels could be provided, which could be arranged at a distance from one another parallel relative to their longitudinal axes. Alternatively, it would also be conceivable to apply the polymer also to the radially inner circumferential surface of the winding mandrel 4, for example in a centrifugal manner. Irrespective of the embodiment mentioned, the finished press cover 20 is finally taken off the at least one winding mandrel 4.

As illustrated in FIG. 3, the press cover 20 is designed according to the invention.

Although this is not illustrated in the figures, the reinforcing structure 20" of the at least one polymer layer 20.1, 20.2 could also be built up from a plurality of laid fabrics of longitudinal and circumferential threads 21.1, 21.2, each extending in the longitudinal axial direction and in the circumferential direction of the press cover 20 and laid above one another in the radial direction.

The invention claimed is:

1. A press cover, comprising: at least one polymer layer having a reinforcing structure embedded therein; said reinforcing structure including at least one reinforcing thread being a longitudinal thread extending in a longitudinal direction of the press cover; said at least one reinforcing thread being formed of a plurality of fibers or fiber bundles interlaced with one another, a number of fibers or fiber bundles from which an individual said reinforcing thread is produced being an odd number greater than one, and said reinforcing thread representing being a flat braid.

2. The press cover according to claim 1, wherein said at least one reinforcing thread is one of a plurality of reinforcing threads each being longitudinal threads, which, extending in the longitudinal direction of the press cover, are arranged at a distance from and parallel to one another over a circumference of the press cover.

3. The press cover according to claim 1, comprising at least one further reinforcing thread being a circumferential thread.

4. The press cover according to claim 3, wherein said at least one further reinforcing thread extends within said polymer layer in form of a helix in a circumferential direction of the press cover.

5. The press cover according to claim 3, wherein a plurality of said reinforcing threads being said longitudinal threads and said at least one further reinforcing thread being a circumferential thread form a laid fabric with one another.

6. The press cover according to claim 5, wherein said longitudinal threads are arranged radially within said at least one circumferential thread, as viewed relative to a longitudinal axis of the press cover.

7. The press cover according to claim 5, wherein, as viewed in the radial direction of the press cover, said longitudinal threads are spaced apart in the radial direction from said at least one circumferential thread at crossing points.

8. The press cover according to claim 1, comprising at least one radially outermost polymer layer, being radially outermost in relation to the longitudinal axis of the press cover, and a radially inner polymer layer, being a radially inner layer in relation to the longitudinal axis of the press cover.

9. The press cover according to claim 8, wherein said radially inner polymer layer has a reinforcing structure embedded therein, said reinforcing structure including at least one reinforcing thread being a longitudinal thread extending in the longitudinal direction of the press cover, and said at least one reinforcing thread being formed of a plurality of fibers or fiber bundles interlaced with one another.

10. The press cover according to claim 8, wherein said outermost and inner polymer layers are exactly two polymer layers of the press cover, and said radially inner polymer layer is a radially innermost polymer layer of the press cover.

11. A press roll for a shoe press for treating a fibrous material web, the press roll comprising at least one press cover according to claim 1.

12. The press roll according to claim 11, being a shoe press roll.

13. A shoe press for treating a fibrous material web, the shoe press comprising:

a press roll and an opposing roll together delimiting a nip; and a rotating press cover being a press cover according to claim 1.

14. A method of treating a fibrous material web, the method comprising:

providing a press cover according to claim 1;

integrating the press cover into a shoe press and treating the fibrous material web in the shoe press.

15. The method according to claim 14, which comprising treating paper, board, tissue, or pulp web.

* * * * *